US005829705A

United States Patent [19]

Carlberg

[11] Patent Number: 5,829,705

[45] Date of Patent: Nov. 3, 1998

[54] APPARATUS FOR AUTOMATIC WINDING OF CABLES, WIRES, CORDS AND THE LIKE

[75] Inventor: Magnus Carlberg, Vickbolandet, Sweden

[73] Assignee: Windak AB, Jarfalla, Sweden

[21] Appl. No.: 750,024

[22] PCT Filed: Feb. 25, 1996

[86] PCT No.: PCT/SE96/00081

§ 371 Date: Jul. 1, 1997

§ 102(e) Date: Jul. 1, 1997

[87] PCT Pub. No.: WO96/22934

PCT Pub. Date: Aug. 1, 1996

[30] Foreign Application Priority Data

Jan. 26, 1995 [SE] Sweden ..... 9500271

[51] Int. Cl.[6] ..... B65H 54/00; B65H 75/28

[52] U.S. Cl. ..... 242/474.7; 242/476.6

[58] Field of Search ..... 242/25 R, 25 A, 242/125.1

[56] References Cited

U.S. PATENT DOCUMENTS

| | | | |
|---|---|---|---|
| 3,858,817 | 1/1975 | Riekkinen | 242/25 A |
| 3,941,329 | 3/1976 | Maillefer et al. . | |
| 3,994,058 | 11/1976 | Sasaki et al. . | |
| 4,119,278 | 10/1978 | Draizen et al. | 242/25 A |
| 4,205,800 | 6/1980 | Melan et al. | 242/125.1 X |
| 4,637,564 | 1/1987 | Hallenbeck et al. | 242/25 A |
| 4,669,679 | 6/1987 | Pali | 242/25 A X |
| 4,883,230 | 11/1989 | Lindström . | |
| 4,979,687 | 12/1990 | Birch | 242/25 A |
| 5,593,101 | 1/1997 | Varga | 242/25 A |

FOREIGN PATENT DOCUMENTS

| | | | |
|---|---|---|---|
| 935136 | 10/1973 | Canada | 242/25 A |
| 295230A1 | 12/1988 | European Pat. Off. . | |
| 369152 | 5/1990 | European Pat. Off. . | |
| 580228 | 1/1994 | European Pat. Off. . | |
| 1323287 | 2/1963 | France | 242/25 A |
| 2375129 | 7/1978 | France . | |
| 2472532 | 7/1981 | France . | |

*Primary Examiner*—Michael Mansen

*Attorney, Agent, or Firm*—Birch, Stewart, Kolasch and Birch, LLP

[57] ABSTRACT

The invention is an apparatus for automatic spooling of cable or other materials of extended lengths onto a drum. Because of difficulties in rapidly and automatically attaching the end of a cable to a drum, existing methods typically are forced to introduce manual labor in the automated process. The invention solves this problem in this manner: an apparatus for cable-laying is placed next to a cable guide in each other's center lines, thereby making it possible to feed the tail end of a cable, with the aid of a device for guiding and for positioning, to the cable guide, which then can guide the cable to a cable clamp placed in the center of a pintle. The main area of use is in the spooling of cables.

10 Claims, 2 Drawing Sheets

APPARATUS FOR AUTOMATIC WINDING OF CABLES, WIRES, CORDS AND THE LIKE

BACKGROUND OF INVENTION

1. Field of the Invention

The invention is an apparatus for fully automatic winding or spooling of cables, wires, or other materials of extended lengths onto a drum equipped with a center hole. Since the chief aim in developing this new apparatus was the automatic spooling of cable, the following description of the invention relates to that material.

2. Description of Background Art

Cable is normally manufactured in great lengths during a continuous process. Most cables are delivered wound onto drums of various sizes. Because of production techniques, it is common today that cable which is to be delivered on small drums (mainly Ø400–Ø1,200 mm.) is first spooled on one large drum, only later to be re-wound on smaller delivery-drums. The reason for this awkward process is that until now no equipment has existed which automatically and speedily makes the switch from a full drum to another empty one. The problem is that currently no method is available for fastening the end of the cable to the new drum, in a manner that is efficient, automatic, and fast enough for delivery purposes.

Yet another crucial problem is how to secure the freshly cut end of the cable onto the full drum.

Further, the direct spooling on small delivery drums (mainly Ø400–Ø1,200 mm.) requires a great amount of manual labor, obviously reducing the production speed. In addition, the introduction of manual labor at this stage brings great risk of accidents since the work necessarily occurs close to rapidly rotating drums. The exact same problem comes up during the re-spooling procedure.

Another issue is the quality of the spooling, which is crucial since the drums are to be delivered to the end user.

There do already exist, however, some methods for automatically fastening the end of a cable onto an empty drum. One way would be to follow the example of Patent No. EP 0 369 152 A1, in which a thread or a wire is attached to the drum automatically and fairly fast. But this method does not allow simultaneous access to both ends. Such an access is essential in those cases when the cable must be tested with an instrument in each of its ends which often occurs at times of delivery of spooled drums to the end user. Thus, this and similar methods are not suitable if the thread or wire are too rigid or thick, as would frequently be the case with cables.

Another example would be Patent No. EP 0 295 230 A1. Here the problem is not lack of access to the ends of the cable but the great limitations in regard to types of cable: the method allows only very flexible and relatively thin cables. Further, this method is incapable of transferring cables from a full drum to an empty drum fast enough for an acceptable production speed in cases of small delivery drums (mainly Ø400–Ø1,200 mm. ) This method is also quite complicated and thus becomes relatively slow. In fact, the technical solution that clearly distinguishes this method from the invention in this patent application has the following weaknesses: the cutting mechanism is so located that the cable first has to be locked, then be given slack, and finally be guided toward the cutting tool in such a way that the cut itself does not take place next to the laying-guide, which then offers a freely suspended cable-end. This laying-guide is therefore not fixed but has to be telescoped in order to be coordinated with the capturing mechanism which passes through a hole in the side of the drum. The fastening device for the end of the cable is placed on a drive arm on the side of the drum.

SUMMARY OF THE INVENTION

The invention in this application is thus an apparatus for the spooling of cable which in an optimal manner solves the problems alluded to above and at the same time to the greatest possible extend eliminates the shortcomings associated with existing spooling principles. These effects have been reached through a series of devices, the defining characteristics of which are specified in the patent claims, which appear below.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
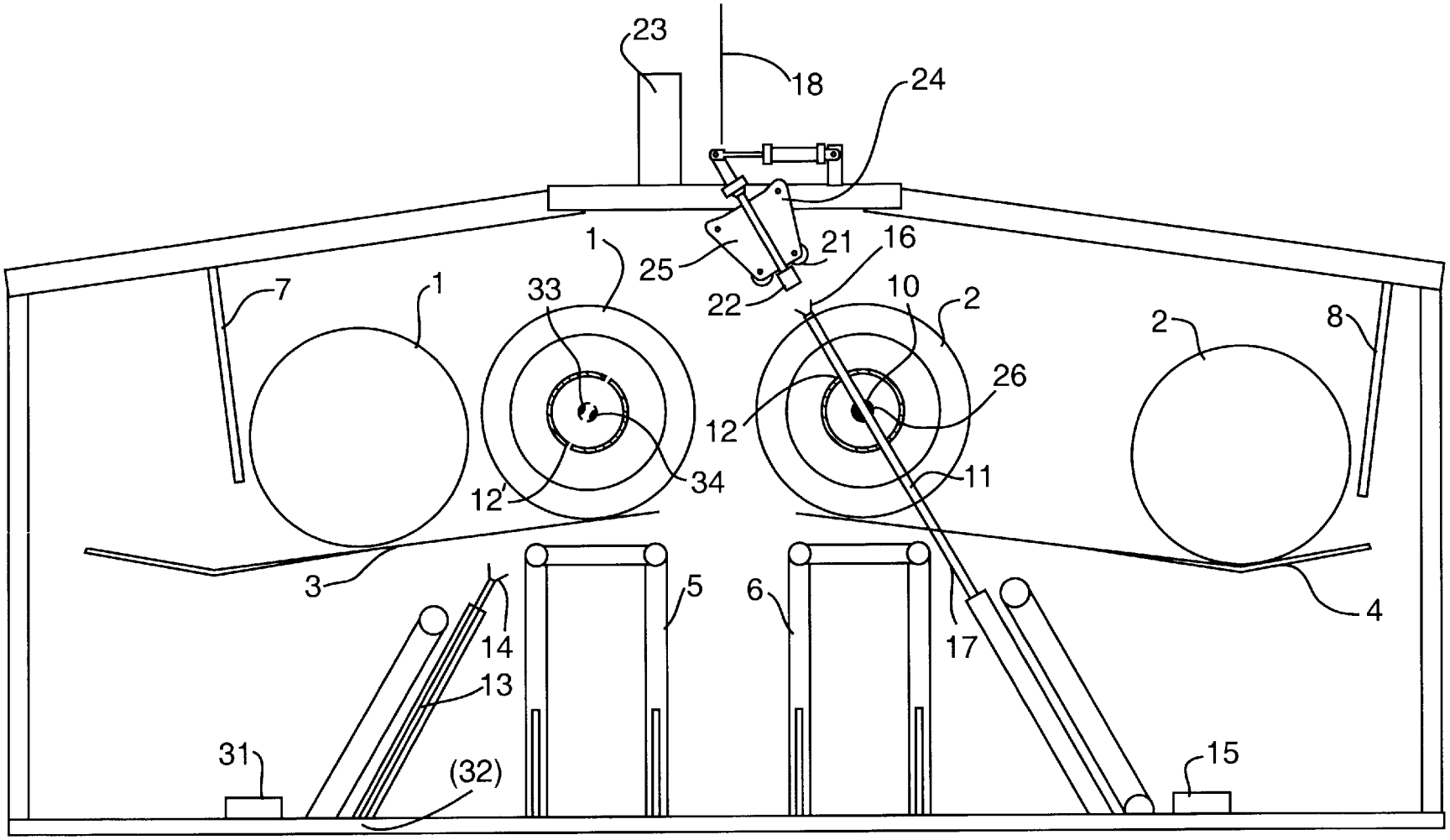
FIG. 1 shows a frontal view of apparatus for automatic spooling of cable according to the invention.
Figure 2:
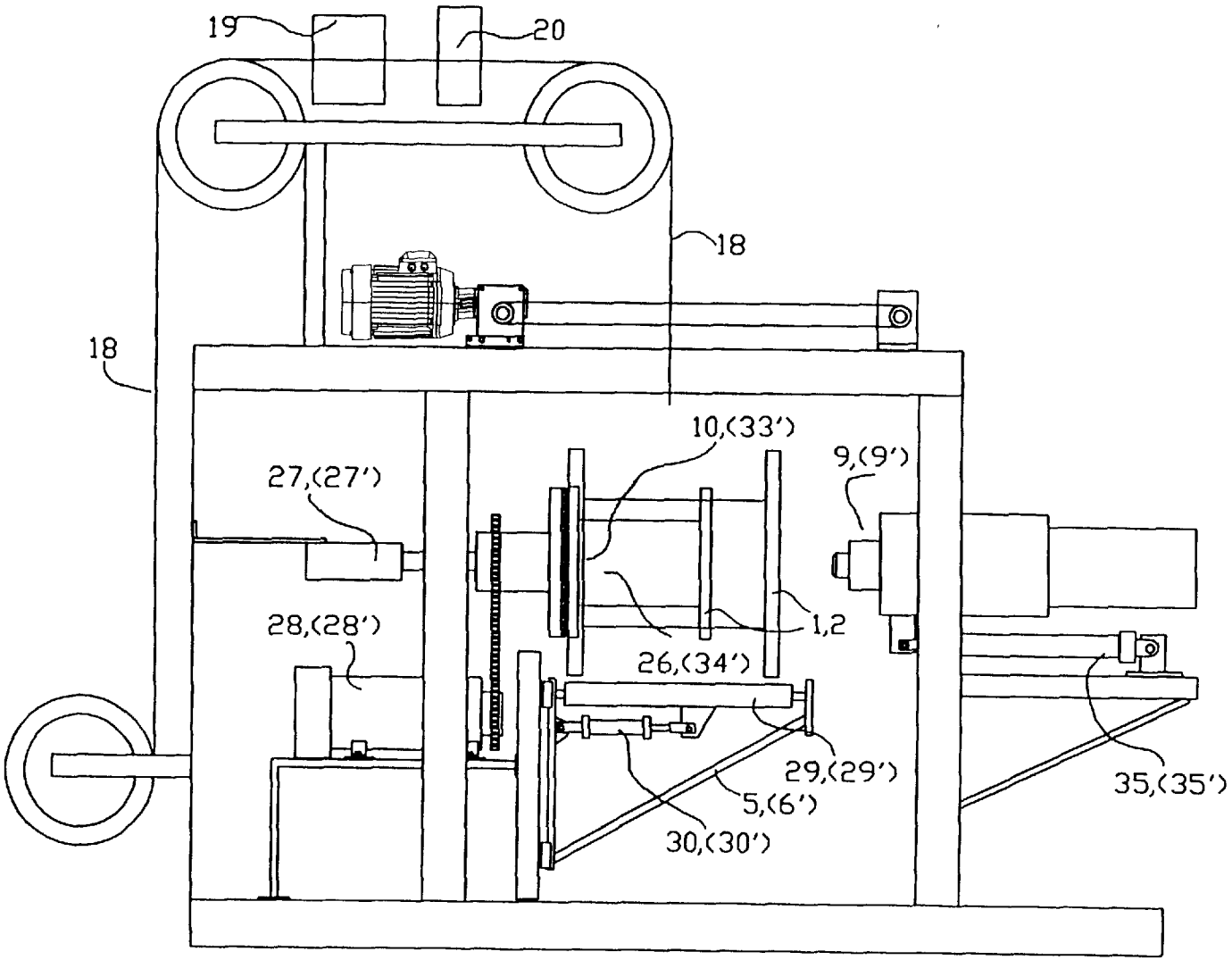
FIG. 2 shows a side view of the same.

The positions of the illustrations indicated within parentheses refer to details which are identical with the positions outside the parentheses but which are concealed in the illustration.

In the defining description, the term cable refers to a stiff or flexible electric conductor, but the invention is also applicable to other types of stiff or flexible extended materials, such as cords, wires and the like.

In the description we will pursue the route of the drums and of the cable until the cable has reached completion in being wound and packed on the drums.

The empty drums (1, 2) advance on conveyor belt (3, 4) for each respective drum. When the drums (1, 2) are in position to be fed to the appropriate lifting device (5 or 6) of the drums (1 or 2), they are fed by feeder arm (7 or 8) for each respective drum (1 or 2). When the feeder arms (7, 8) have positioned the drums (1, 2) exactly above the lifting devices (5, 6), the drums (1, 2) are brought by the lifting devices (5, 6) to a position where the center hole of the drums (1, 2) will be precisely in front of two pintles or gripping pins (9, 10 or 9', 33), one for each drum (1, 2). One pintle (9 or 9') is not fixed and can be moved in an extended axial line from the center of drum (1 or 2). When a respective drum (1 or 2) is facing pintles (9, 10 or 9', 33), one of the pintles (9 or 9') will—with the help of a power device (35 or 35')—be pushed into the center hole of the drum (1 or 2). Pintle (9 or 9') is shaped in such a way that after it has been pushed to a certain depth inside the center hole of drum (1 or 2), it will push the drum (1 or 2) in its axial direction so that it is moved up onto the other pintle (10 or 33). Drum (1 or 2) is then fixed in place through hanging from pintles (9, 10 or 9' or 33), in both their ends. The lifting device (5 or 6) is thereafter lowered to permit drum (1 or 2) to freely rotate. Drum (1 or 2) is then positioned to face a cable guide (11 or 13) which can penetrate a hole (12 or 12') all the way through to the center of the drum's core. Next, with the aid of a power device (15 or 31), the cable guide (11 or 13) is moved through drum (1 or 2) to position (A) outside the outer limits of drum (1 or 2). Finally a device for guiding and for positioning (14 or 16) is opened, with the help of another power mechanism (17 or 32). At this point, the cable guide (11 or 13) is in perfect position to capture a cable (18).

The cable (18) now arrives—via a device for measuring length (19) and another device for cable-feeding (20)—at a set of mechanisms for cable-laying (21–22). The cable-laying mechanism consists of a device for guiding (21) and another one for cutting (22). With the aid of a power device (23), the cable-laying mechanism is capable of moving in a parallel line to the axial center lines of drums (1, 2). In one specific location—in relation to the axial axle of drums (1, 2)—the cable-laying apparatus (21–22) is capable with the aid of two feeding mechanisms (24, 25) to be guided to a position in front of the previously mentioned device for guiding and positioning (14 or 16). After that, the feeding mechanisms (24, 25) will advance the end of the cable (18) into one of the devices for guiding and positioning (14 or 16).

Cable (18) is locked in position in this guiding and positioning device (14 or 16) with the aid of a power mechanism (17 or 32). Cable guide (11 or 13), in coordination with one of the devices for guiding and positioning (14 or 16), is now retracted by power mechanism (15 or 31) and moved to location (B) past a cable clamp (26 or 34), which is placed in pintle (10 or 33), ultimately. At the same time as the cable guide (11 or 13) is retracted, the cable-feeding device (20) advances a length of cable at a speed which is synchronized with the cable guide (11 or 13). In this position, the cable clamp (26 or 34) firmly attaches the end of cable (18)—with the aid of power device (27 or 27')—in the pintle's center axle. At this point, the device for guiding and positioning (14 or 16) opens up, and the cable guide (11 or 13) is pulled back to a location that is free from the drum (1 or 2). Now drum (1 or 2)—with the aid of power device (28 or 28')—can rotate to properly spool cable (18).

After a desired length of cable (18) has been wound onto drum (1 or 2), the spooling is stopped and cable (18) is cut by the cutting mechanism (22), which is fitted inside the cable-laying apparatus (21–22). At once after the cut, this apparatus (21–22) is guided to the exact location by the one of the devices for guiding and positioning (14 or 16) which is next to the empty drum (1 or 2). This procedure will then be repeated, alternating between drum (1) and drum (2).

After the cutting of cable (18), the full drum (1 or 2) is automatically covered with a thin, self-adhesive plastic wrap. This procedure thus secures the tail end of the cable (18) after it has been cut. Next, the lifting device (5 or 6) is moved to a location where it touches the outer flanges of the drum (1 or 2). At this point, the power device (35 or 35') pulls pintle (9 or 9') back to its original position, clear of the drum (1 or 2). Upon this, a carriage (29 or 29') driven by power mechanism (30 or 30') pulls the drum (1 or 2) away from the pintle (10 or 33); the drum (1 or 2) is now free and can be lowered by the lifting device (5 or 6) into a position where the feeding arm (7 or 8) rolls out the drum (1 or 2) onto the conveyor belt (3 or 4). This belt (3 or 4) then advances the full drum out of the apparatus and simultaneously feeds a fresh, empty drum into the system.

Clearly, then, the invented apparatus elegantly solves all the problems associated with the shaping of a complex and automatic spooling of cable, wire, cord, or the like onto small drums (chiefly Ø400–Ø1,200 mm. ), while this apparatus at the same time effectively eliminates the weaknesses apparent in already existing apparatuses.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An automatic spooling apparatus comprising:

a cable feeding device;

a cable guiding device disposed adjacent to said feeding device;

a cable cutting device disposed adjacent to said cable guiding device;

means for automatically engaging and moving a cable from the cable cutting device through a side opening in a hollow shaft of a spool to a central region of the shaft of the spool;

means for rotatably supporting the shaft of the spool, said means for rotatably supporting the shaft is spaced from said cable cutting device; and means for automatically engaging the cable in the central region of the shaft of the spool and stably holding the cable during rotation of the spool, whereby automated spooling efficiency is substantially increased while manual labor is substantially reduced.

2. The automatic spooling apparatus of claim 1, wherein the means for rotatably supporting the shaft further includes a pintle which supports the shaft of the spool, and the means for automatically engaging the cable further includes a cable clamp disposed in the central region of the shaft of the spool which attaches to an end portion of the cable.

3. The automatic spooling apparatus of claim 2, wherein the pintle is a first pintle, the means for rotatably supporting the shaft further includes a first pintle powering device for rotating the first pintle, a second pintle which engages and pushes the shaft of the spool on to the first pintle, and a second pintle powering device for extending and retracting said second pintle.

4. The automatic spooling apparatus of claim 2, wherein said means for automatically engaging the cable includes a clamp powering device for actuating the cable clamp.

5. The automatic spooling apparatus of claim 1, further comprising:

a conveyor belt for moving the spool from a first position to a second position, a feeder arm for moving the spool from the second position and precisely positioning the spool in a loading position, and a lifting device for elevating the spool from a loading position to a position where said means for rotatably supporting the shaft contacts the shaft of the spool.

6. The automatic spooling apparatus of claim 5, wherein the lifting device further includes a carriage which pulls the spool away from the means for rotatably supporting the shaft.

7. A method for automatic spooling comprising the steps of:

moving a cable guide through a side opening of a spool shaft;

advancing a predetermined amount of cable from a cable feeding device;

automatically engaging and moving the cable with the cable guide from the cable feeding device through an a side of the shaft of the spool to a central region of the shaft of a spool;

automatically clamping the cable in the central region of the shaft of the spool;

releasing the cable from the cable guide;

retracting the cable guide out of a side of the spool shaft; and spooling cable onto the shaft of the spool by rotating the shaft, whereby automated spooling efficiency is substantially increased while manual labor is substantially reduced.

8. The method of claim 7, further comprising the steps of:

moving the spool by a conveyor belt for a predetermined distance precisely positioning the spool adjacent to a lifting device;

elevating the spool with the lifting device;

pushing the spool with a first pintle against a second pintle;

placing the shaft of the spool onto the second pintle;

lowering the lifting device; and spooling cable onto the shaft of the spool by rotating the first and second spindles.

9. The method of claim 8, further comprising the steps of:

cutting the cable with a cutting device after spooling has stopped;

automatically covering the spool with a wrapping material; and elevating the lifting device.

10. The method of claim 8, further comprising the steps of:

retracting the first pintle;

pulling the shaft of the spool away from the second pintle;

lowering the lifting device while supporting the spool on the lifting device;

pushing the spool onto the conveyor belt; and moving the spool after with the conveyor belt away from the first and second pintles.

* * * * *